US007717231B2

(12) United States Patent
Horton

(10) Patent No.: US 7,717,231 B2
(45) Date of Patent: May 18, 2010

(54) LADDER GUARD

(75) Inventor: Peter Donald Horton, Donvale (AU)

(73) Assignee: Surrey Hills Hire Pty. Ltd. (AU)

( * ) Notice: Subject to any disclaimer, the term of this patent is extended or adjusted under 35 U.S.C. 154(b) by 0 days.

(21) Appl. No.: 11/224,402

(22) Filed: Sep. 12, 2005

(65) Prior Publication Data

US 2006/0076188 A1 Apr. 13, 2006

(30) Foreign Application Priority Data

Sep. 13, 2004 (AU) ..... 2004905266

(51) Int. Cl.
*E06C 7/18* (2006.01)

(52) U.S. Cl. ..... 182/106

(58) Field of Classification Search ..... 182/106, 182/230, 129

See application file for complete search history.

(56) References Cited

U.S. PATENT DOCUMENTS 1,198,739 A * 9/1916 Marciniak et al. ..... 182/29
2,419,727 A * 4/1947 Picone ..... 182/121
3,225,863 A 12/1965 Ludlow
3,503,468 A * 3/1970 Taylor, Sr. ..... 182/121
4,126,206 A 11/1978 Becnel
4,450,937 A * 5/1984 Broughton ..... 182/206
5,072,979 A * 12/1991 Swinton ..... 293/128
D353,469 S * 12/1994 Skaggs ..... D25/68
5,421,428 A * 6/1995 Ingles ..... 182/106
5,441,126 A * 8/1995 Orrick ..... 182/106
6,364,057 B1 * 4/2002 Cornejo et al. ..... 182/106
2002/0153202 A1 * 10/2002 Sawicki et al. ..... 182/129

FOREIGN PATENT DOCUMENTS

GB 2370309 A * 6/2002

* cited by examiner

*Primary Examiner*—Alvin C Chin-Shue
(74) *Attorney, Agent, or Firm*—Andrus, Sceales, Starke & Sawall, LLP

(57) ABSTRACT

A ladder guard (10) for use with a ladder (8) having a plurality of rungs (8*a*-8*f*). The ladder guard has a first position, in which respective portions (21-23) of the ladder guard are located in front of a number of the rungs (8*b*-8*d*) to prevent access to the rungs. The ladder guard has a second position, in which the portions (21-23) of the ladder guard are located behind rungs of the ladder to allow access to the rungs of the number of rungs. The ladder guard includes a support (12) for supporting the ladder guard on a ladder for movement from the first to the second position by lifting the portions of the ladder guard up and over the rungs of the number of rungs. The ladder guard further includes means to releasably lock the ladder guard in the first position.

17 Claims, 3 Drawing Sheets

LADDER GUARD

CROSS REFERENCE TO RELATED APPLICATION

The present application claims priority from Australian Patent Application No. 2004905266, filed Sep. 13, 2004.

FIELD OF THE INVENTION

The present invention relates to ladder guards for preventing unauthorised use of a ladder.

BACKGROUND OF THE INVENTION

It is often desirable to be able to prevent use of a ladder, especially when ladders provide ready access to buildings, vehicles or towers.

On both domestic and commercial building sites, ladders are commonly left on site, overnight and on weekends, ready for use on the next working day. During this time they allow easy access to upper levels and roofs, which may be unsafe. As well as the dangers of locations able to be accessed by ladders left on site, the ladders themselves can present a hazard to unauthorised users.

Unauthorised users may be children, vandals, thieves or people wishing to survey the progress of the building works.

Ladder guards have been developed that block access to a ladder in a number of alternative ways. U.S. Pat. No. 4,126,206 discloses a ladder guard having two sheets of metal pivotally joined together. The upper sheet hooks over a rung of the ladder. The lower sheet includes a portion that engages a rung from behind. The lower sheet is locked into position to prevent removal of the guard and access to the ladder. This guard must be completely removed and installed at the beginning and end of every day.

There are a number of other ladder guards disclosed in patent specifications, that simply sit over the front of the ladder engaging one rung at one end and locking onto the ladder at the other end. As with the previously described ladder guard, each of these devices must be fully removed and installed at the beginning and end of every day. Whilst installation is relatively straightforward, the ladder guard must be retrieved from its storage location, installed onto the ladder and locked into position. This process means that many of the people working on a typical building site, such as builders and other trades people, are likely to leave at the end of the day without installing the ladder guards. That is, there is a significant disincentive to reliable daily use of the ladder guards.

U.S. Pat. No. 3,225,863 discloses a ladder guard having a panel which is hingedly mounted at one side to the ladder, such that the panel can swing around to allow or prevent access to the ladder. The ladder guard is permanently installed on the ladder and therefore a site worker would simply swing the panel across the ladder and lock it into a closed position.

While this construction overcomes the problems of a separate ladder guard, it presents new problems. The ladder guard takes up space next to the ladder when open, thus preventing the ladder from being positioned next to an access opening or doorway. The ladder guard could be easily broken as people move past it, catching things on it when in the open position. The ladder guard, when in a closed and locked position, does not prevent access to the rear of the ladder, and indeed the ladder can still be used unless it is permanently affixed to a wall.

It is therefore an object of the present invention to provide an improved ladder guard that overcomes at least some of the problems with the prior art described.

The applicant does not concede that the prior art discussed above forms part of the common general knowledge in the art in Australia at the priority date.

SUMMARY OF THE INVENTION

The invention provides a ladder guard for use with a ladder, the ladder having a plurality of rungs, the ladder guard having:

a first position, in which respective portions of the ladder guard are located in front of a number of said rungs to prevent access to the rungs; and a second position, in which said portions of the ladder guard are located behind rungs of the ladder to allow access to the rungs of said number of rungs;

wherein the ladder guard includes means for supporting the ladder guard on a ladder for movement from said first to said second position by lifting said portions of the ladder guard up and over the rungs of said number of rungs;

and wherein the ladder guard further includes means to releasably lock the ladder guard in said first position.

Preferably, the rungs behind which said portions of the ladder guard are located in said second position are the same rungs to which access is prevented in said first position.

Preferably, said portions of the ladder guard comprise respective panel members for each rung to which access is prevented in said first position. The ladder guard is then moveable between said first and second positions by moving the ladder guard to lift said panel members up and over a respective rung of said number of rungs.

Advantageously, said number of rungs is at least three successive rungs, preferably four or five successive rungs.

Said means for supporting the ladder guard on a ladder comprises at least one segment, preferably at the top of the ladder guard, having hook means for hooking said segment on a rung. This segment advantageously includes a handle suitable to be grasped by hand for lifting the ladder guard.

Said means for locking the ladder guard in said second position includes means to lock at least one said portion onto a rung with a padlock or the like.

Advantageously, said ladder guard is wholly between the side rails of the ladder in both of said first and second positions.

BRIEF DESCRIPTION OF THE DRAWINGS

The invention will now be further described, by way of example only, with reference to the accompanying drawings, in which.

DESCRIPTION OF PREFERRED EMBODIMENTS

Figure 2:
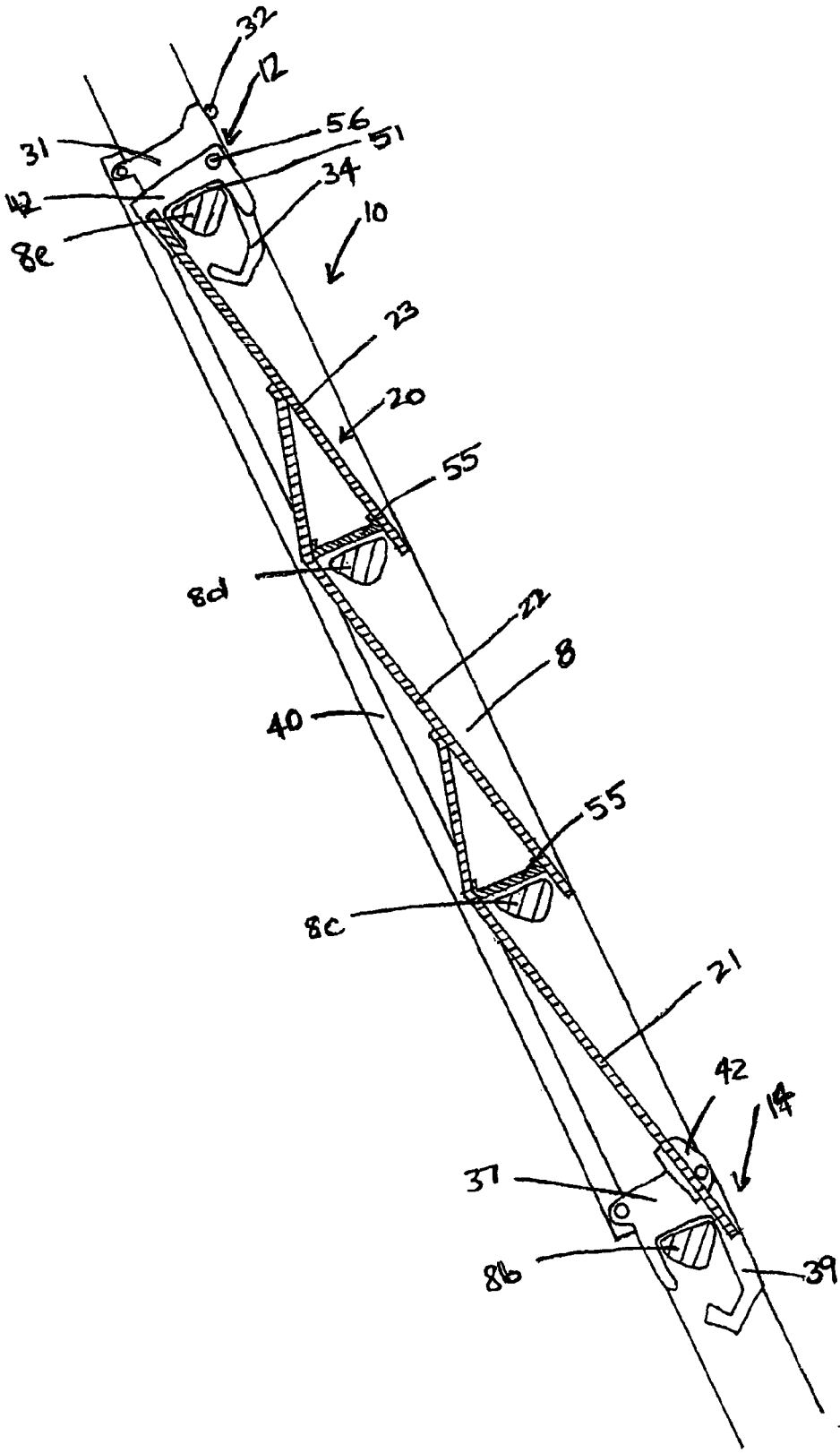
FIG. 2 is a vertical cross-sectional of view of the ladder guard in the access preventing position.
Figure 3:
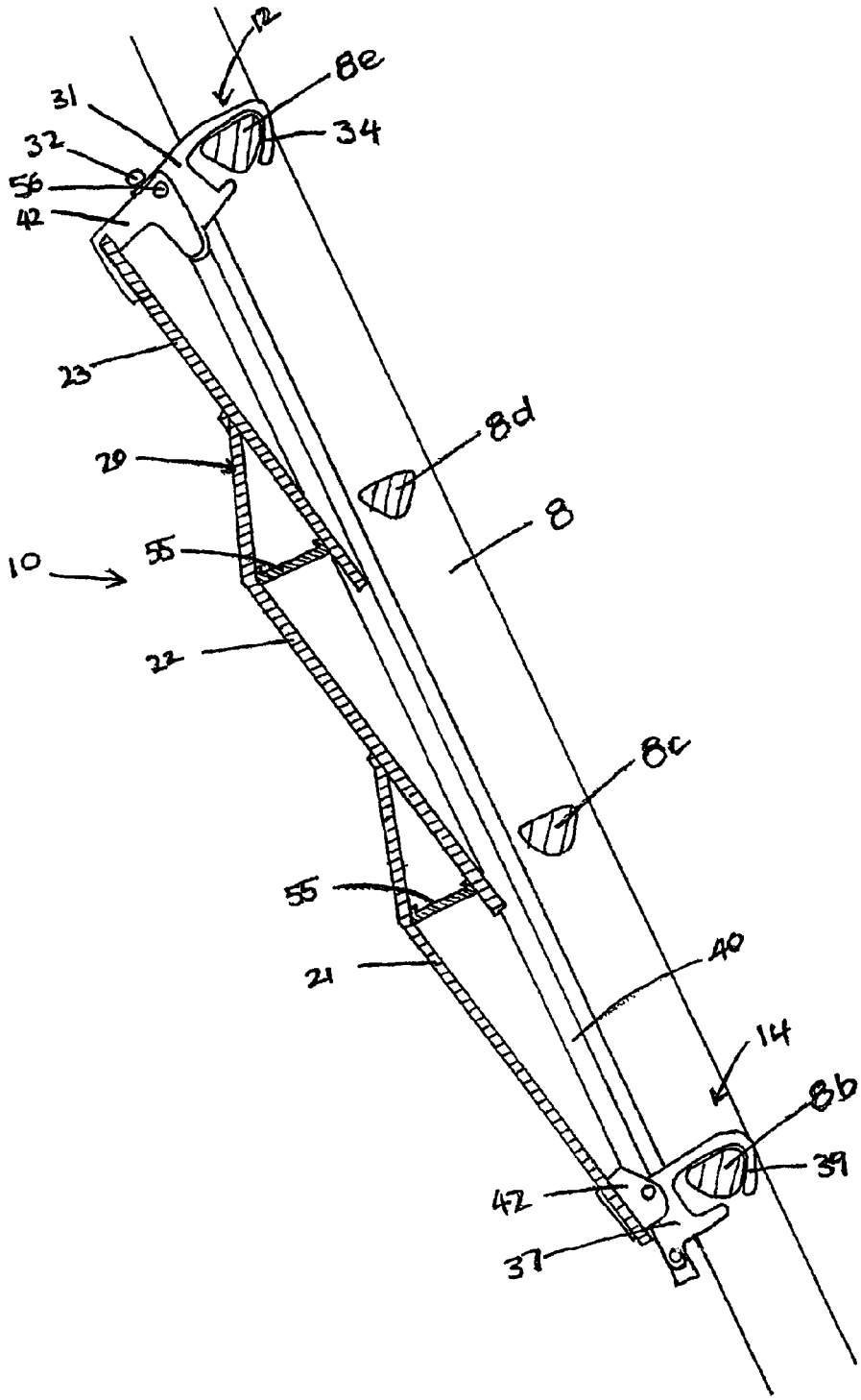
FIG. 3 is a view similar to FIG. 2 of the ladder guard in its retracted access permitting position, and also shows an intermediate position in dashed lines.

The illustrated ladder guard 10 is intended to be left permanently in position on a ladder 8 that is itself in position and upright, but is adapted to be readily moved by hand between an access preventing position (FIGS. 1 and 2) and a retracted or access permitting position (FIG. 3). It is dimensioned to block access to three successive rungs 8*b*-8*d* of a ladder. The three rungs above the bottom rung are thought to be an optimum location.

The ladder guard 10 has upper and lower support assemblies 12,14 for supporting the ladder guard from the second and fifth rungs from the bottom, and a blocking structure 20 having three discrete light metal (eg. aluminium) plates 21-23 pivotably attached to assemblies 12,14 for movement between a first, access preventing position in which plates 21-23 are located in front of and block access to the respective rungs 8*b*-8*d*, and a second, retracted, access permitting position (FIG. 3) in which the plates are located behind the respective rungs.

The upper support assembly 12 has respective side plates 30,31 linked at the rear by an upper crossbar 32 that also serves as a handle, and shaped at their front to form a hook 34 for hanging the plates off a ladder rung 8*e*. Lower support assembly 14 similarly has respective side plates 36,37 with separate hook seats 38,39 for hanging the plates off rung 8*b* at the respective positions of the ladder guard. The two support assemblies are linked together by respective tie rods 40, at the sides, pivotably attached to the respective plates 30,31; 36,37, and by blocking structure 20, also pivotably attached to and between plates 30,31; 36,37.

Blocking structure 20 is a rigid assembly of the three generally rectangular plates 21-23. Each is dimensioned to be able to extend obliquely from in front of and just below its respective rung and up behind the next rung above. The plates are arranged in a staggered, slightly overlapping relationship, joined together at each overlap point on both sides by metal straps 55 welded to each plate. The top plate 23 is attached to side plates 30,31 via brackets 41,42, which are fixed to top plate 23 and pivotably attached to side plates 30,31 by pin 56.

Figure 1:
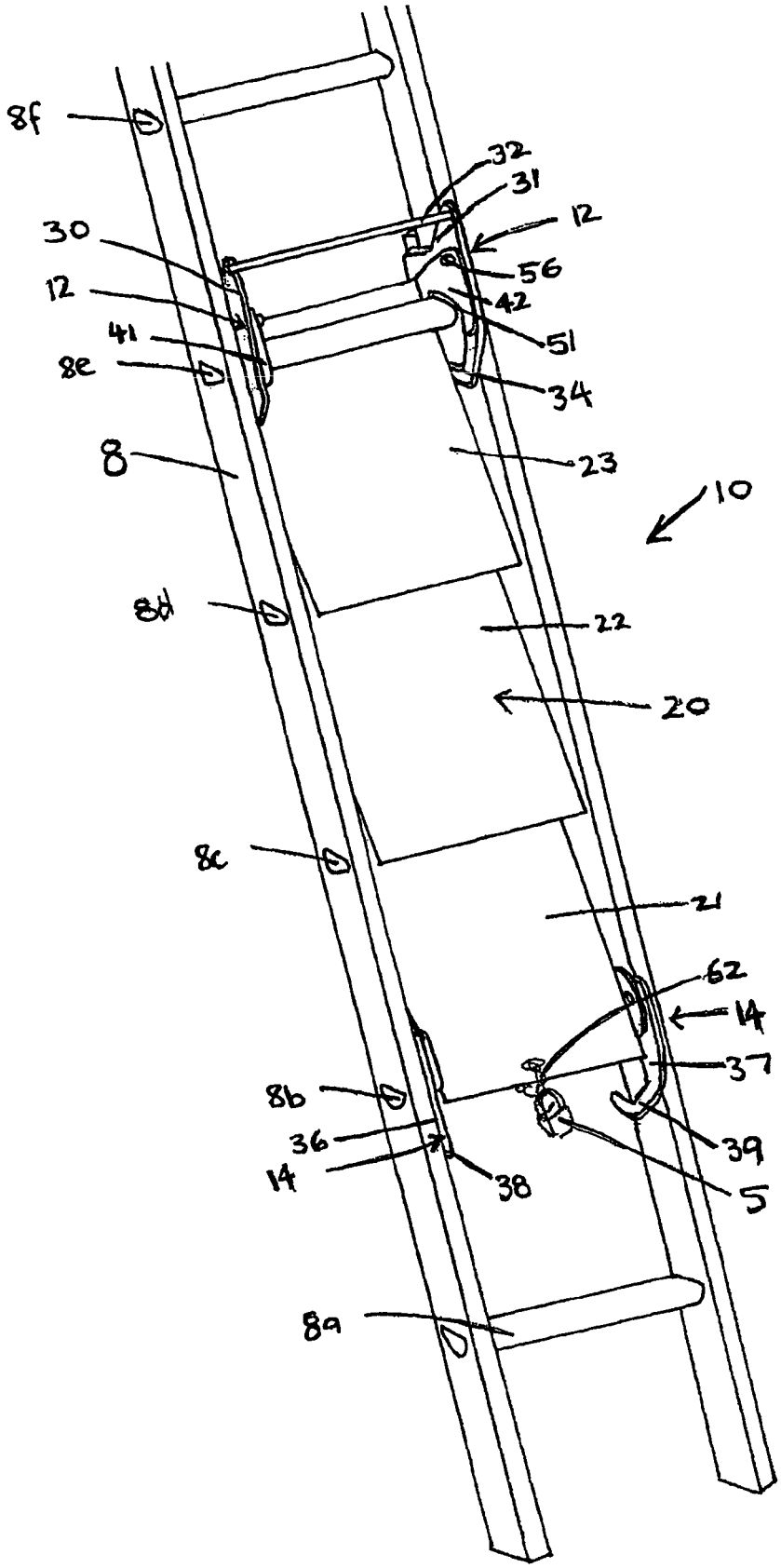
FIG. 1 is a perspective view of a ladder guard according to an embodiment of the invention, shown in its locked position preventing access to the three rungs above the bottom rung of a ladder.

In the access preventing position, shown in FIGS. 1 and 2, upper side plates 30,31 are hooked forwarding onto rung 8*e* by shaped seats 51 on the side plates. The respective plates 21-23 extend from behind each rung to in front of the next lowest rung, and the position is locked by applying a padlock 5 or similar to a chain 62 suspended through an eye 60 at the bottom edge of lowermost plate 21, and about rung 8*b*. It will be seen that no-one can place their feet on the ladder rungs 8*b*-8*d* from the front, nor from behind.

To move the ladder guard to its retracted position, an operator removes padlock 5 and chain 62 and grasps crossbar 32 to lift the whole device up, back and down to relocate side plates 30,31; 36,37 from seats 51 to seats 38, 39 on the respective rungs 8*e*, 8*b*, and to lift plates 21-24 up over and behind the respective rungs.

The retracted position is defined by engagement of hooks 34 with rung 8*e*. It will be seen that plates 21-23 lie a distance behind the rear edges of rungs 8*b*-8*d*, thereby giving good room for a firm foothold on each rung. The weight of ladder guard 10 holds it away from ladder 8.

At the end of a work session, a site worker need simply grasp crossbar 32 to lift the guard up, forward and down to its access preventing position, and then apply chain 62 and padlock 5. Access is blocked until the commencement of the next work session.

It will be seen from the drawings that no part of the device protrudes laterally of the ladder side rails in either position of the device, and there is therefore no lateral restriction on the location of the ladder, and no protruding components to cause difficulty to those passing or working near the ladder.

I claim:

1. A ladder guard configured for movable attachment to a ladder having elongated rails and a series of spaced apart rungs extending between the rails, the ladder guard comprising:

a blocking structure comprising at least a first panel member and a second panel member, each having an upper end and a lower end, the upper end of the second panel member being coupled to the lower end of the first panel member;

an upper support assembly pivotally connected to the upper end of the first panel member and including a first rung engagement mechanism for engagement with an upper rung of the series of rungs; and a lower support assembly pivotally connected to a lower end of the blocking structure and including a second rung engagement mechanism for engagement with a rung below the upper rung in the series of rungs;

a means for moving the upper support assembly and the lower support assembly in unison;

wherein the ladder guard is configured to move about the ladder by moving the blocking structure with respect to the upper and lower support assemblies between:

a first position, in which each respective panel member of the ladder guard is located in front of a respective ladder rung to prevent access to the respective rung; and a second position, in which each panel member of the ladder guard is located behind the respective rungs of the ladder to allow access to the respective rungs;

whereby the movement from the first position to the second position includes an upward component and a rearward component to move each respective panel member upward and over the respective rung while the first and second rung engagement mechanisms are able to maintain engagement with the rungs; and a locking device to releasably lock the ladder guard with the panel members in said first position.

2. A ladder guard according to claim 1, wherein the rung behind which each said panel member of the ladder guard is located in said second position is the respective rung, to which access is prevented in said first position.

3. A ladder guard according to claim 1, wherein the blocking structure comprises at least three panel members.

4. A ladder guard according to claim 3, wherein the blocking structure comprises four panel members.

5. A ladder guard according to claim 2, wherein the blocking structure comprises at least three panel members.

6. A ladder guard according to claim 5, wherein the blocking structure comprises four panel members.

7. A ladder guard according to claim 1, wherein said rung engagement mechanism comprises at least one segment having a hook for hooking said segment on a rung.

8. A ladder guard according to claim 7, wherein the at least one segment is at the top of the ladder guard.

9. A ladder guard according to claim 7, wherein the at least one segment includes a handle suitable to be grasped by hand for lifting the ladder guard.

10. A ladder guard according to claim 1, wherein said locking device includes a mechanism to lock at least one said panel member onto a rung with a padlock.

11. A ladder guard according to claim 7, wherein said locking device includes a mechanism to lock at least one said panel member onto a rung with a padlock.

12. A ladder guard according to claim 1, wherein said ladder guard is wholly between the side rails of the ladder in both of said first and second positions.

13. A ladder guard according to claim 7, wherein said ladder guard is wholly between the side rails of the ladder in both of said first and second positions.

14. The ladder guard according to claim 1, wherein the lower support assembly includes a hook configured to engage said lower rung.

15. The ladder guard according to claim 1, wherein the blocking structure further includes a strap that connects the first panel member to the second panel member.

16. The ladder guard according to claim 14, wherein said means for moving comprising a tie rod connecting the upper support assembly to the lower support assembly, such that the upper and lower support assemblies move in unison.

17. The ladder guard according to claim 15, wherein the ladder guard is moved from the first position to the second position by lifting the panel members up, over and behind the respective rung for each panel member.

* * * * *